US010614946B2

(12) United States Patent
Tozawa et al.

(10) Patent No.: US 10,614,946 B2
(45) Date of Patent: Apr. 7, 2020

(54) ELECTRONIC COMPONENT

(71) Applicant: TDK CORPORATION, Tokyo (JP)

(72) Inventors: Yoji Tozawa, Tokyo (JP); Masashi Shimoyasu, Tokyo (JP); Junichi Otsuka, Tokyo (JP); Tsutomu Ono, Tokyo (JP); Hidekazu Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 106 days.

(21) Appl. No.: 15/814,063

(22) Filed: Nov. 15, 2017

(65) Prior Publication Data

US 2018/0137964 A1 May 17, 2018

(30) Foreign Application Priority Data

Nov. 16, 2016 (JP) ..... 2016-223222

(51) Int. Cl.

*H01F 27/29* (2006.01)
*H01F 27/245* (2006.01)
*H01F 17/00* (2006.01)
*H01F 27/28* (2006.01)

(52) U.S. Cl.

CPC ..... *H01F 27/245* (2013.01); *H01F 17/0013* (2013.01); *H01F 17/0033* (2013.01); *H01F 27/2804* (2013.01); *H01F 27/292* (2013.01); *H01F 2017/0066* (2013.01); *H01F 2027/2809* (2013.01)

(58) Field of Classification Search

CPC ..... H01F 17/0013; H01F 17/0033; H01F 2017/0066; H01F 27/245; H01F 27/292; H01F 27/2804; H01F 2027/2809

USPC ..... 336/200, 192, 223; 361/301.4

See application file for complete search history.

(56) References Cited

U.S. PATENT DOCUMENTS

2009/0284896 A1* 11/2009 Sakaguchi ..... H01G 4/005 361/303
2016/0042857 A1* 2/2016 Chun ..... H01F 17/0013 336/200
2016/0099106 A1* 4/2016 Kurokawa ..... H01G 4/0085 361/301.4
2016/0172110 A1* 6/2016 Otani ..... H01G 4/30 361/301.4
2017/0186549 A1 6/2017 Kurokawa et al.
2017/0186550 A1 6/2017 Kurokawa et al.
2017/0263382 A1 9/2017 Kurokawa et al.
2017/0287644 A1 10/2017 Kurokawa et al.

FOREIGN PATENT DOCUMENTS

JP 2015-053495 A 3/2015
JP 2015053495 A * 3/2015 ..... H01C 7/008

* cited by examiner

*Primary Examiner* — Mang Tin Bik Lian
(74) *Attorney, Agent, or Firm* — Oliff PLC

(57) ABSTRACT

An electronic component includes a body and a pair of terminal electrodes. The body has a pair of end faces opposing each other in a first direction, a pair of main faces opposing each other in a second direction, and a pair of side faces opposing each other in a third direction. One of the main faces serves as a mounting face. A clearance in the first direction between an end edge of a conductive resin layer and the end edge of a base metal layer at an end portion of the one of the main faces in the third direction is longer than a clearance in the first direction between the end edge of the conductive resin layer and the end edge of the base metal layer at a central portion of the one of the main faces in the third direction.

4 Claims, 7 Drawing Sheets

ELECTRONIC COMPONENT

TECHNICAL FIELD

One aspect of the present invention relates to an electronic component.

BACKGROUND

An electronic component includes a body having a pair of end faces, a pair of main faces and a pair of side faces, and a pair of terminal electrodes disposed on the pair of end faces (e.g., see Japanese Unexamined Patent Publication No. 2015-53495). In the electronic component described in Patent Document 1, each terminal electrode has a sintered metal layer and a conductive resin layer covering the sintered metal layer. The conductive resin layer serves as a buffer layer which absorbs impact and suppresses the occurrence of cracks in the body.

SUMMARY

One aspect of the present invention provides an electronic component in which the occurrence of cracks in the body is further suppressed.

As a result of research and investigation, the inventors newly found the following facts.

In the electronic component described in Japanese Unexamined Patent Publication No. 2015-53495, the pair of terminal electrodes is soldered to an electronic device (e.g., a circuit board or other electronic component), thereby being mounted on the electronic device. For example, when the electronic device is a plate like a circuit board, deflection may occur in the electronic device. When the deflection occurs in the electronic device, stress caused by the deflection of the electronic device may act on the electronic component through the solder. Suppose that one of the pair of main faces of the body is a mounting face opposing the electronic device, the stress tends to be concentrated on the end edges of the sintered metal layer at end portions of the side face sides of the mounting face of the electronic component. This may cause cracks in the body starting from the end edges at these portions.

An electronic component according to one aspect of the present invention includes a body with a rectangular parallelepiped shape and a pair of terminal electrodes. The body has a pair of end faces opposing each other in a first direction, a pair of main faces opposing each other in a second direction, and a pair of side faces opposing each other in a third direction. One of the main faces serves as a mounting face. The pair of terminal electrodes is disposed on the pair of end faces. Each of the pair of terminal electrodes includes a base metal layer and a conductive resin layer. The base metal layer is disposed at least on the end faces and the one of the main faces. The conductive resin layer is disposed in such a way as to cover an entire end edge of the base metal layer on the one of the main faces. A clearance in the first direction between an end edge of the conductive resin layer and the end edge of the base metal layer at an end portion of the one of the main faces in the third direction is longer than a clearance in the first direction between the end edge of the conductive resin layer and the end edge of the base metal layer at a central portion of the one of the main faces in the third direction.

In this electronic component, the conductive resin layer is disposed in such a way as to cover the entire end edge of the base metal layer on the one of the main faces. Thus, the conductive resin layer absorbs impact on the end edge of the base metal layer on the one of the main faces. As described above, when the electronic component is mounted on an electronic device, the stress caused by the deflection of the electronic device tends to be concentrated on the end edge of the base metal layer at the end portion of the mounting face in the third direction. Herein, a length, in the first direction, of an extra portion provided in the conductive resin layer for the base metal layer is longer at the end portion than the central portion of the one of the main faces and the mounting face, in the third direction. This can further suppress the occurrence of cracks in the body.

In this electronic component, a length of the base metal layer in the first direction at the end portion of the one of the main faces in the third direction may be shorter than a length of the base metal layer in the first direction at the central portion of the one of the main faces in the third direction. In this case, the end edge of the first electrode layer at the end portion of the one of the main faces in the third direction, where the cracks start in the body, can be brought close to corner portions of the end face sides. The stress caused by the deflection of the electronic device is hardly applied to the corner portions of the end face sides. As a result, the occurrence of cracks in the body can be further suppressed.

In this electronic component, the end edge of the conductive resin layer on the one of the main faces may be curved. In this case, the end edge of the conductive resin layer on the one of the main faces is longer than the straight end edge since the end edge is curved. This can disperse the stress concentrated on the end edge of the conductive resin layer on the one of the main faces. Therefore, the occurrence of cracks in the body starting from the end edge of the conductive resin layer can be suppressed.

This electronic component may further include coil conductors constituting a coil inside the body. The base metal layer on the one of the main faces may be spaced apart from the coil conductors when viewed from the second direction. In this case, even if cracks occur in the body starting from the end edge of the base metal layer on the mounting face, the cracks hardly affect the coil conductors. Therefore, deterioration of the electrical characteristics of the coil is suppressed.

DETAILED DESCRIPTION

Hereinafter, an embodiment will be described in detail with reference to the accompanying drawings. In the description, the same reference signs are used for the same elements and elements having the same functions, and redundant descriptions are omitted.

Figure 1:
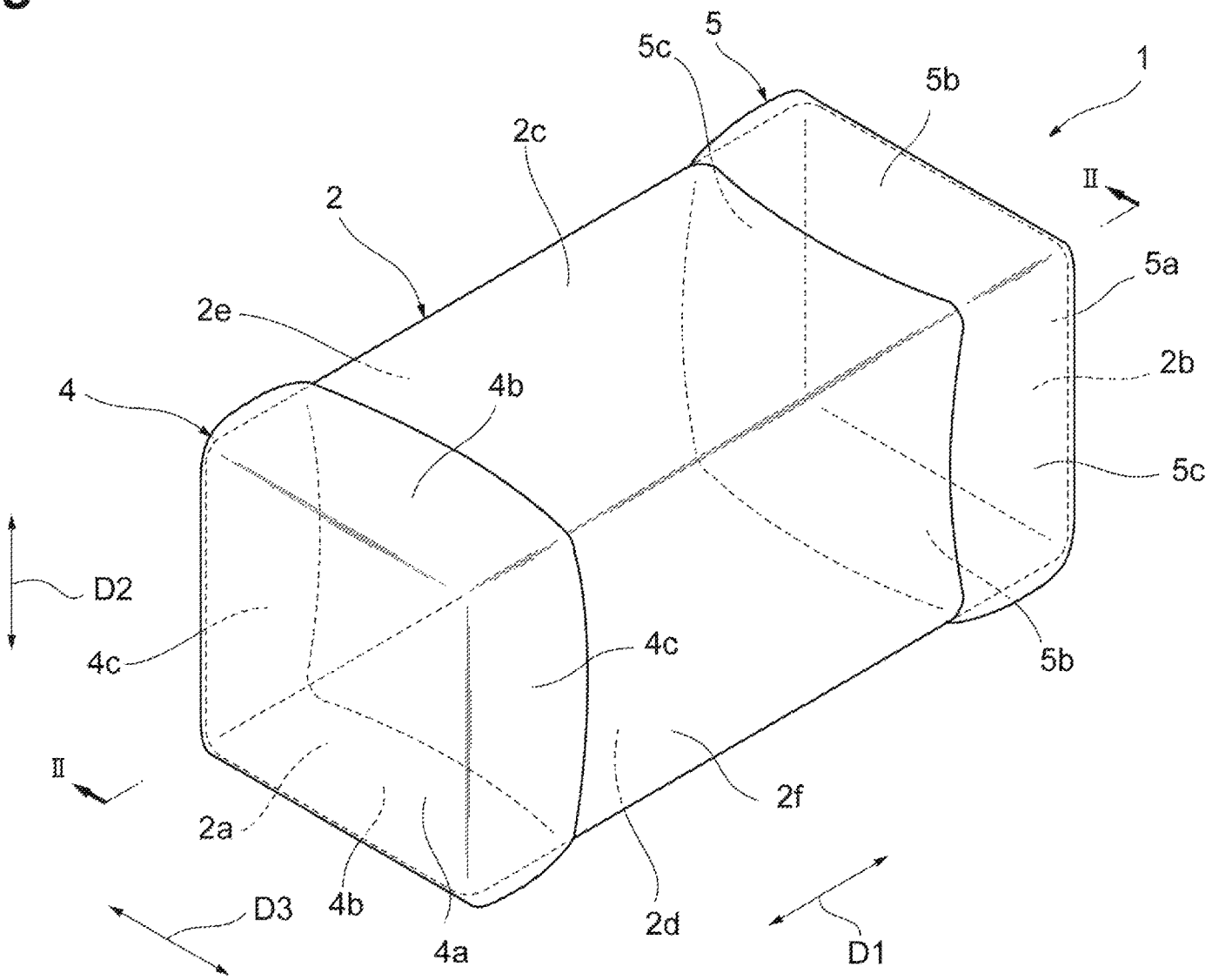
FIG. 1 is a perspective view showing a laminated coil component according to the embodiment.
Figure 2:
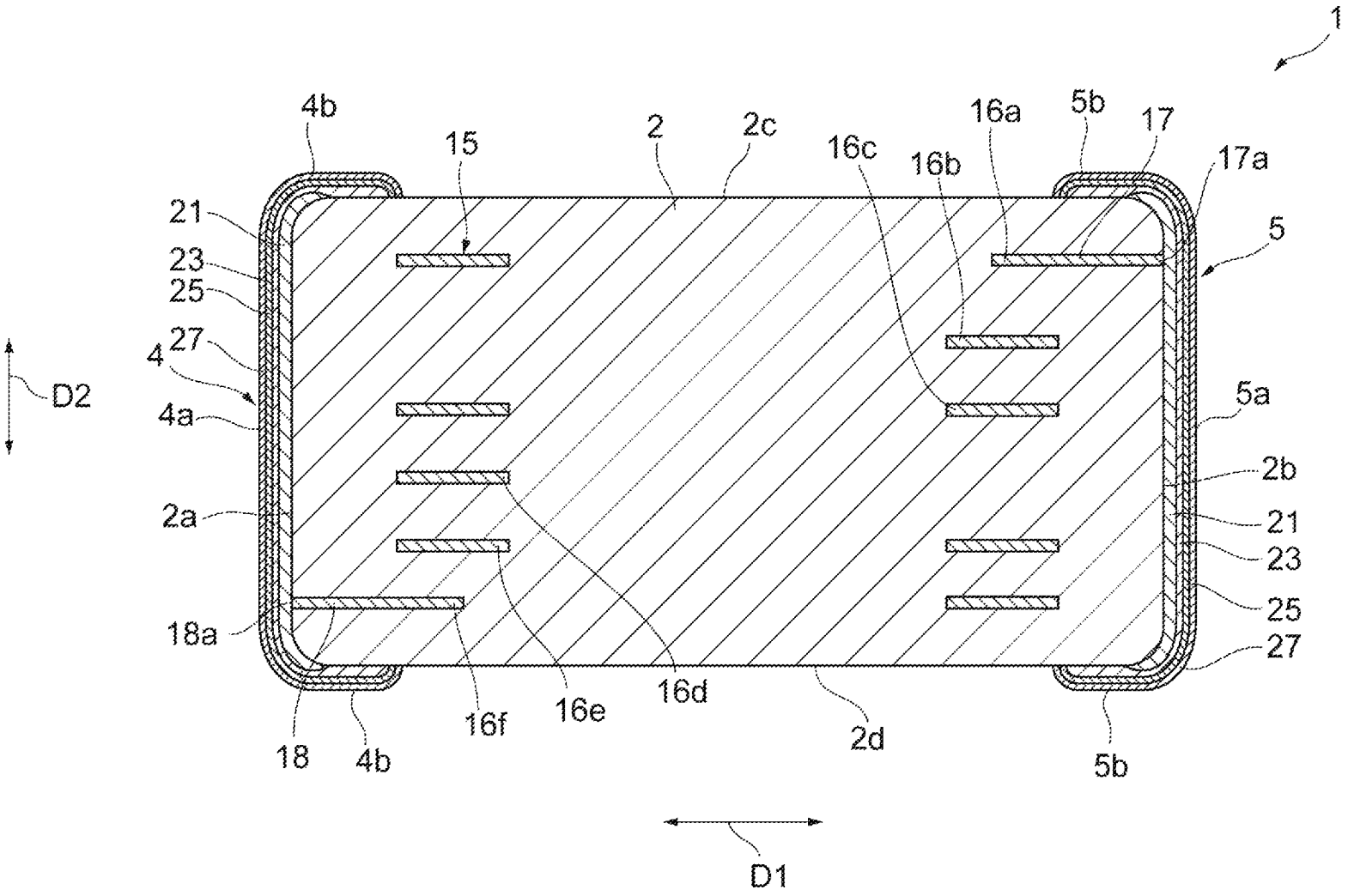
FIG. 2 is a cross-sectional view along the line II-II in FIG. 1.
Figure 3:
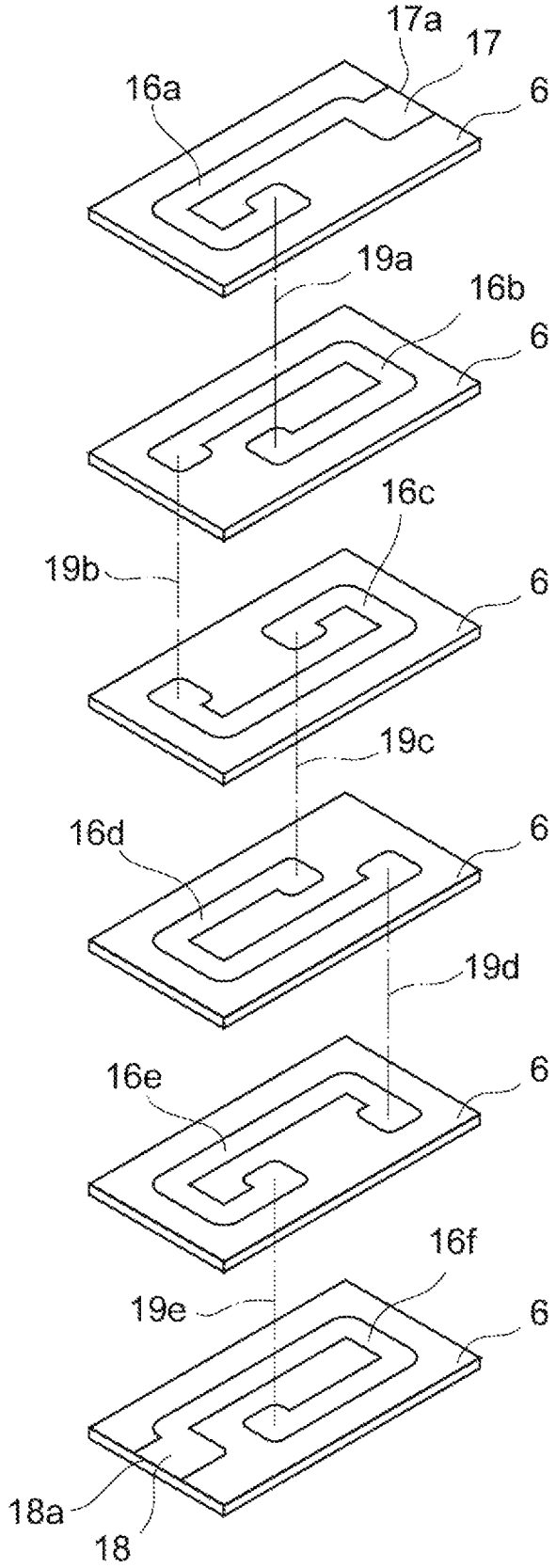
FIG. 3 is a perspective view showing the structures of internal conductors.

The structure of a laminated coil component 1 according to the embodiment will be described with reference to FIGS. 1 to 3. FIG. 1 is a perspective view showing a laminated coil component according the embodiment. FIG. 2 is a cross-sectional view along the line II-II in FIG. 1. FIG. 3 is a perspective view showing the structures of internal conductors. In the embodiment, the laminated coil component 1 is described as an example of the electronic component.

As shown in FIG. 1, the laminated coil component 1 includes a body 2 with a rectangular parallelepiped shape, and a pair of terminal electrodes 4 and 5. The rectangular parallelepiped shape includes a rectangular parallelepiped shape, in which corner portions and ridgeline portions are chamfered, and a rectangular parallelepiped shape, in which the corner portions and the ridgeline portions are rounded. The laminated coil component 1 can be applied to, for example, a bead inductor or a power inductor.

The body 2 has a rectangular parallelepiped shape. The body 2 has, as the surfaces thereof, a pair of end faces 2*a* and 2*b* opposing each other, a pair of main faces 2*c* and 2*d* opposing each other, and a pair of side faces 2*e* and 2*f* opposing each other. The end faces 2*a* and 2*b* are positioned in such a way as to be adjacent to the pair of main faces 2*c* and 2*d*. The end faces 2*a* and 2*b* are positioned in such a way as to be also adjacent to the pair of side faces 2*e* and 2*f*. The main face 2*c* serves as a face (mounting face) opposing an unillustrated electronic device (e.g., a circuit board or other electronic component) when, for example, the laminated coil component 1 is mounted on the electronic device.

In the embodiment, a direction in which the pair of end faces 2*a* and 2*b* oppose each other (a first direction D1) is the length direction of the body 2. A direction in which the pair of main faces 2*c* and 2*d* opposes each other (a second direction D2) is the height direction of the body 2. A direction in which the pair of side faces 2*e* and 2*f* opposes each other (a third direction D3) is the width direction of the body 2. The first direction D1, the second direction D2 and the third direction D3 are orthogonal to each other.

A length of the body 2 in the first direction D1 is longer than a length of the body 2 in the second direction D2 and a length of the body 2 in the third direction D3. The length of the body 2 in the second direction D2 and the length of the body 2 in the third direction D3 are the same. That is, in the embodiment, the pair of end faces 2*a* and 2*b* has a square shape, and the pair of main faces 2*c* and 2*d* and the pair of side faces 2*e* and 2*f* have a rectangular shape. The length of the body 2 in the first direction D1 may be the same as the length of the body 2 in the second direction D2 and the length of the body 2 in the third direction D3. The length of the body 2 in the second direction D2 and the length of the body 2 in the third direction D3 may be different.

In addition to being equal, values including slight differences in a preset range, manufacturing errors or the like may be considered as the same. For example, when multiple values are included in a range of ±5% of the average value of the multiple values, the multiple values are defined as the same.

The end faces 2*a* and 2*b* extend in the second direction D2 in such a way as to connect the pair of main faces 2*c* and 2*d*. The end faces 2*a* and 2*b* also extend in the third direction D3 in such a way as to connect the pair of side faces 2*e* and 2*f*. The main faces 2*c* and 2*d* extend in the first direction D1 in such a way as to connect the pair of end faces 2*a* and 2*b*. The main faces 2*c* and 2*d* also extend in the third direction D3 in such a way as to connect the pair of side faces 2*e* and 2*f*. The side faces 2*e* and 2*f* extend in the second direction. D2 in such a way as to connect the pair of main faces 2*c* and 2*d*. The side faces 2*e* and 2*f* also extend in the first direction. D1 in such a way as to connect the pair of end faces 2*a* and 2*b*.

The body 2 is constituted by laminating a plurality of insulator layers 6 (see FIG. 3). Each insulator layer 6 is laminated in the direction in which the main face 2*c* and the main face 2*d* oppose each other. That is, a laminating direction of each insulator layer 6 coincides with the direction in which the main face 2*c* and the main face 2*d* oppose each other. Hereinafter, the direction in which the main face 2*c* and the main face 2*d* oppose each other is also referred to as the "laminating direction". Each insulator layer 6 has a substantially rectangular shape. In the actual body 2, each insulator layer 6 is integrated in such a way that no boundary can be visually recognized.

Each insulator layer 6 includes a sintered body of a ceramic green sheet containing a ferrite material (e.g., Ni—Cu—Zn ferrite material, Ni—Cu—Zn—Mg ferrite material, or Ni—Cu ferrite material). That is, the body 2 includes a ferrite-sintered body.

As shown in FIGS. 2 and 3, the laminated coil component 1 further includes, as internal conductors, a plurality of coil conductors 16*a*, 16*b*, 16*c*, 16*d*, 16*e* and 16*f*, a pair of connection conductors 17 and 18 and a plurality of through hole conductors 19*a*, 19*b*, 19*c*, 19*d*, and 19*e*. The plurality of coil conductors 16*a* to 16*f* constitute a coil 15 inside the body 2. The plurality of coil conductors 16*a* to 16*f* include a conductive material (e.g., Ag or Pd). The plurality of coil conductors 16*a* to 16*f* are constituted as sintered bodies of a conductive paste containing a conductive material (e.g., Ag powder or Pd powder).

The connection conductor 17 is connected to the coil conductor 16*a*. The connection conductor 17 is disposed on the end face 2*b* side of the body 2. The connection conductor 17 has an end portion 17*a* exposed on the end face 2*b*. The end portion 17*a* is exposed at a position closer to the main face 2*c* than a central portion of the end face 2*b* when viewed from a direction orthogonal to the end face 2*b*. The end portion 17*a* is connected to the terminal electrode 5. That is, the coil conductor 16*a* is electrically connected to the terminal electrode 5 through the connection conductor 17. In the embodiment, a conductor pattern of the coil conductor 16*a* and a conductor pattern of the connection conductor 17 are integrally and continuously formed.

The connection conductor 18 is connected to the coil conductor 16*f*. The connection conductor 18 is disposed on the end face 2*a* side of the body 2. The connection conductor 18 has an end portion 18*a* exposed on the end face 2*a*. The end portion 18*a* is exposed at a position closer to the main face 2*d* than a central portion of the end face 2*a* when viewed from a direction orthogonal to the end face 2*a*. The end portion 18*a* is connected to the terminal electrode 4. That is, the coil conductor 16*f* is electrically connected to the terminal electrode 4 through the connection conductor 18. In the embodiment, a conductor pattern of the coil conductor 16*f* and a conductor pattern of the connection conductor 18 are integrally and continuously formed.

The plurality of coil conductors 16*a* to 16*f* are juxtaposed in the laminating direction of the insulator layers 6 inside the body 2. The plurality of coil conductors 16*a* to 16*f* are arranged in the order of the coil conductor 16*a*, the coil conductor 16*b*, the coil conductor 16*c*, the coil conductor 16*d*, the coil conductor 16*e* and the coil conductor 16*f* from the main face 2*c*.

The through hole conductors 19*a* to 19*e* connect end portions of the coil conductors 16*a* to 16*f* to each other. The coil conductors 16*a* to 16*f* are electrically connected to each other by the through hole conductors 19*a* to 19*e*. The coil 15 is constituted by electrically connecting the plurality of coil conductors 16*a* to 16*f*. Each of the through hole conductors 19*a* to 19*e* includes a conductive material (e.g., Ag or Pd). Like the plurality of coil conductors 16*a* to 16*f*, each of the through hole conductors 19*a* to 19*e* is constituted as a sintered body of a conductive paste containing a conductive material (e.g., Ag powder or Pd powder).

The plurality of through hole conductors 19*a* to 19*e* are juxtaposed in the laminating direction of the insulator layers 6 inside the body 2. The plurality of through hole conductors 19*a* to 19*e* are arranged in the order of the through hole conductor 19*a*, the through hole conductor 19*b*, the through hole conductor 19*c*, the through hole conductor 19*d*, and the through hole conductor 19*e* from the main face 2*c*.

As shown in FIGS. 1 and 2, the pair of terminal electrodes 4 and 5 is disposed on the pair of end face 2*a* and 2*b* sides, respectively, and is spaced apart from each other in the first direction D1. The terminal electrode 4 is positioned at an end portion of the end face 2*a* side in the first direction D1 in the body 2. The terminal electrode 4 has an electrode portion 4*a* positioned on the end face 2*a*, a pair of electrode portions 4*b* positioned on the pair of main faces 2*c* and 2*d*, and a pair of electrode portions 4*c* positioned on the pair of side faces 2*e* and 2*f*. That is, the terminal electrode 4 is disposed on the five faces 2*a*, 2*c*, 2*d*, 2*e* and 2*f*.

The electrode portions 4*a*, 4*b* and 4*c*, which are adjacent to each other, are electrically connected at the ridgeline portions of the body 2. The electrode portion 4*a* and each of the electrode portions 4*b* are connected at the ridgeline portions between the end face 2*a* and each of the main faces 2*c* and 2*d*. The electrode portion 4*a* and each of the electrode portions 4*c* are connected at the ridgeline portions between the end face 2*a* and each of the side faces 2*e* and 2*f*.

The electrode portion 4*a* is disposed in such a way as to cover the entire end portion 18*a*. The connection conductor 18 is directly connected to the terminal electrode 4. That is, the connection conductor 18 connects the coil conductor 16*f* (one end of the coil 15) and the electrode portion 4*a*. The coil 15 is thus electrically connected to the terminal electrode 4.

The terminal electrode 5 is positioned at an end portion of the end face 2*b* side in the first direction D1 in the body 2. The terminal electrode 5 has an electrode portion 5*a* positioned on the end face 2*b*, a pair of electrode portions 5*b* positioned on the pair of main faces 2*c* and 2*d*, and a pair of electrode portions 5*c* positioned on the pair of side faces 2*e* and 2*f*. That is, the terminal electrode 5 is disposed on the five faces 2*b*, 2*c*, 2*d*, 2*e* and 2*f*.

The electrode portions 5*a*, 5*b* and 5*c*, which are adjacent to each other, are electrically connected to each other at the ridgeline portions of the body 2. The electrode portion 5*a* and each of the electrode portions 5*b* are connected at the ridgeline portions between the end face 2*b* and each of the main faces 2*c* and 2*d*. The electrode portion 5*a* and each of the electrode portions 5*c* are connected at the ridgeline portions between the end face 2*b* and each of the side faces 2*e* and 2*f*.

The electrode portion 5*a* is disposed in such a way as to cover the entire end portion 17*a*. The connection conductor 17 is directly connected to the terminal electrode 5. That is, the connection conductor 17 connects the coil conductor 16*a* (the other end of the coil 15) and the electrode portion 5*a*. The coil 15 is thus electrically connected to the terminal electrode 5.

Each of the pair of terminal electrodes 4 and 5 has a first electrode layer 21, a second electrode layer 23, a third electrode layer 25 and a fourth electrode layer 27. In the embodiment, each of the electrode portions 4*a*, 4*b* and 4*c* and the electrode portions 5*a*, 5*b* and 5*c* includes the first electrode layer 21, the second electrode layer 23, the third electrode layer 25 and the fourth electrode layer 27. In other words, each of the first electrode layers 21, the second electrode layers 23, the third electrode layers 25 and the fourth electrode layers 27 is disposed on the pair of end faces 2*a* and 2*b*, the pair of main faces 2*c* and 2*d* and the pair of side faces 2*e* and 2*f*. The fourth electrode layers 27 constitute the outermost layers of the terminal electrodes 4 and 5.

For example, the first electrode layers 21 are formed as follows: a conductive paste is adhered onto the surfaces of the body 2 by an immersing (dipping) method and then fired at a predetermined temperature (e.g., approximately 700 degrees). That is, the first electrode layers 21 are sintered metal layers formed by sintering a metal ingredient (metal powder) contained in the conductive paste. The first electrode layers 21 are base metal layers for forming the second electrode layers 23 and are disposed at least on the pair of end faces 2*a* and 2*b* and the main face 2*c*. As described above, in the embodiment, the first electrode layers 21 are disposed on the pair of end faces 2*a* and 2*b*, the pair of main faces 2*c* and 2*d* and the pair of side faces 2*e* and 2*f*.

In the embodiment, the first electrode layers 21 are sintered metal layers made of Ag. The first electrode layers 21 may be sintered metal layers made of Pd. Thus, the first electrode layers 21 include Ag or Pd. For the conductive paste, a mixture of Ag or Pd powder, a glass ingredient, an organic binder and an organic solvent, is used.

The second electrode layers 23 are disposed in such a way as to cover entire end edges 21*a* of the first electrode layers 21 on the main face 2*c*. In the embodiment, the second electrode layers 23 are disposed in such a way as to cover the entire first electrode layers 21. That is, the second electrode layers 23 are disposed in such a way as to cover the entire first electrode layers 21 included in the electrode portions 4*a*, 4*b* and 4*c* and the electrode portions 5*a*, 5*b* and 5*c*. For example, the second electrode layers 23 are formed as follows: a conductive paste is adhered onto the surfaces of the first electrode layers 21 and the body 2 by an immersing method, and then a conductive resin is cured.

That is, the second electrode layers 23 are conductive resin layers formed on the first electrode layers 21. For the conductive resin, a mixture of a thermosetting resin, metal powder, an organic solvent and the like is used. As the metal powder, for example, Ag powder is used. As the thermosetting resin, for example, a phenol resin, an acrylic resin, a silicone resin, an epoxy resin or a polyimide resin is used.

The third electrode layers 25 are formed on the second electrode layers 23 by a plating method. In the embodiment, the third electrode layers 25 are Ni plated layers formed on the second electrode layers 23 by Ni plating. The third electrode layers 25 may be Sn plated layers, Cu plated layers or Au plated layers. Thus, the third electrode layers 25 include Ni, Sn, Cu or Au.

The fourth electrode layers 27 are formed on the third electrode layers 25 by a plating method. In the embodiment, the fourth electrode layers 27 are Sn plated layers formed on the third electrode layers 25 by Sn plating. The fourth electrode layers 27 may be Cu plated layers or Au plated layers. Thus, the fourth electrode layers 27 include Sn, Cu or Au. The third electrode layers 25 and the fourth electrode layers 27 constitute plated layers formed on the second electrode layers 23. That is, in the embodiment, the plated layers formed on the second electrode layers 23 have a two-layer structure.

Figure 4:
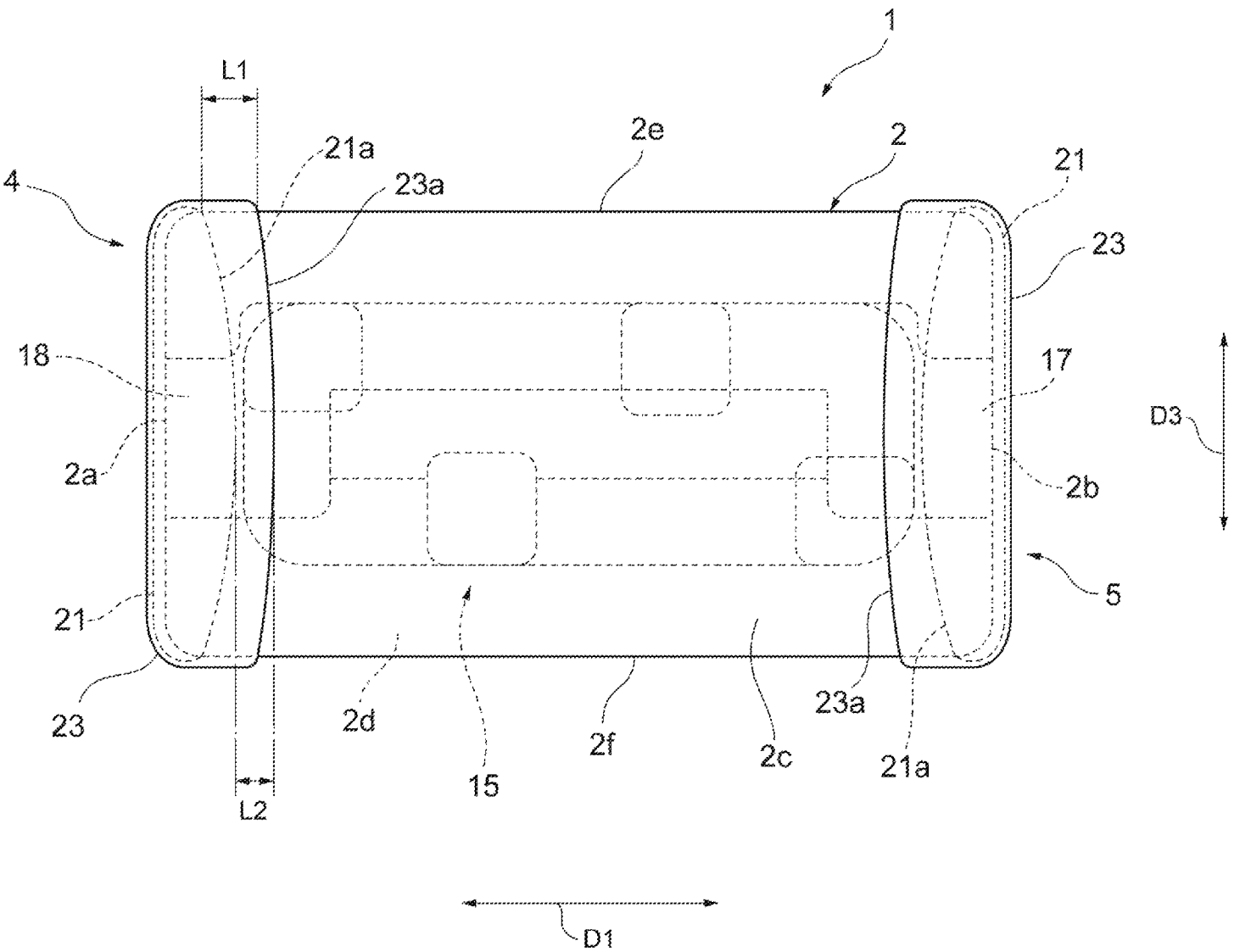
FIG. 4 is a plan view of the laminated coil component viewed from a mounting face.

Next, the shapes of the first electrode layers 21 and the second electrode layers 23 on the main face 2*c* will be described in detail with reference to FIG. 4. FIG. 4 is a plan view of the laminated coil component viewed from a mounting face. In the embodiment, the shapes of the pair of terminal electrodes 4 and 5 are the same. Therefore, as an example, the following description will be made based on the shapes of the first electrode layer 21 and the second electrode layer 23 of the terminal electrode 4. In FIG. 4, the third electrode layers 25 and the fourth electrode layers 27 are omitted.

As shown in FIG. 4, the end edge 21*a* of the first electrode layer 21 on the main face 2*c* is curved in such a way as to protrude from a central portion in the third direction D3 when viewed from the second direction D2. Suppose that a length of the first electrode layer 21 on the main face 2*c* in the first direction D1 (that is, a length from the end face 2*a* to the end edge 21*a* in the first direction D1) is a first electrode length, the first electrode length at end portions in the third direction D3 is shorter than the first electrode length at the central portion in the third direction D3. The first electrode length becomes the shortest at the end portions and the longest at the central portion in the third direction D3. When the corner portions and the ridgeline portions of the body 2 are chamfered, or when the corner portions and the ridgeline portions are rounded, a length from an imaginary plane including the end face 2*a* to the end edge 21*a* in the first direction D1 is defined as the first electrode length.

The first electrode length monotonically increases from the end portions to the central portion on the main face 2*c* in the third direction D3. The first electrode length is adjusted by, for example, an upbound amount of the conductive paste when the body 2 is immersed in the conductive paste. The upbound amount of the conductive paste is a length that the conductive paste rises from a liquid surface along the surfaces of the body 2. Herein, the monotonic increase means that there is no tendency to decrease and means a monotonic increase in a broad sense.

The end edge 23*a* of the second electrode layer 23 on the main face 2*c* is curved in such a way as to protrude from the central portion of the main face 2*c* in the third direction D3 when viewed from the second direction D2 (see FIG. 1). Suppose that a length of the second electrode layer 23 on the main face 2*c* in the first direction D1 (that is, a length from the end face 2*a* to the end edge 23*a* in the first direction D1) is a second electrode length, the second electrode length at the end portions in the third direction D3 is shorter than the second electrode length at the central portion in the third direction D3. The second electrode length becomes the shortest at the end portions and the longest at the central portion in the third direction D3. When the corner portions and the ridgeline portions of the body 2 are chamfered, or when the corner portions and the ridgeline portions are rounded, a length from the imaginary plane including the end face 2*a* to the end edge 23*a* in the First direction D1 is defined as the second electrode length.

The second electrode length monotonically increases from the end portions to the central portion in the third direction D3. The second electrode length is adjusted by, for example, an upbound amount of the conductive resin in a paste form when the body 2 is immersed in the conductive resin. The upbound amount of the conductive resin is a length that the conductive resin rises from a liquid surface along the surfaces of the first electrode layer 21 and the body 2.

A clearance between the end edge 23*a* and the end edge 21*a* in the first direction D1 is equal to a difference between the second electrode length and the first electrode length. Hereinafter, the clearance between the end edge 23*a* and the end edge 21*a* in the first direction D1 is also simply referred to as a "clearance". Suppose that the clearance at the end portions of the main face 2*c* in the third direction D3 is L1 and the clearance at the central portion of the main face 2*c* in the third direction. D3 is L2, L1 is longer than L2. The clearance monotonically decreases from the end portions to the central portion on the main face 2*c* in the third direction D3. That is, the maximum value of the clearance is L1 and the minimum value is L2.

In the embodiment, the shapes of the first electrode layers 21 and the second electrode layers 23 on the main face 2*d* and the pair of side faces 2*e* and 2*f* are the same as the shapes of the first electrode layers 21 and the second electrode layers 23 on the main face 2*c* described above.

Next, relationships between the first electrode layers 21 and the coil conductors 16*a* to 16*f* and the pair of connection conductors 17 and 18 will be described with reference to FIGS. 3 and 4.

The first electrode layers 21 on the main face 2*c* are spaced apart from the coil conductors 16*a* to 16*f* constituting the coil 15 when viewed from the second direction D2 (see FIG. 1). That is, the first electrode layers 21 on the main face 2*c* do not overlap the coil conductors 16*a* to 16*f* when viewed from the second direction D2. The first electrode layers 21 on the main face 2*c* overlap the pair of connection conductors 17 and 18 when viewed from the second direction D2.

Although not shown, the first electrode layers 21 on the main face 2*d* are spaced apart from the coil conductors 16*a* to 16*f* when viewed from the second direction D2. That is, the first electrode layers 21 on the main face 2*d* do not overlap the coil conductors 16*a* to 16*f* when viewed from the second direction. D2. The first electrode layers 21 on the main face 2*d* overlap the pair of connection conductors 17 and 18 when viewed from the second direction D2. In other words, the first electrode layers 21 included in the electrode portions 4*b* and the electrode portions 5*b* are spaced apart from the coil conductors 16*a* to 16*f* and overlap the pair of connection conductors 17 and 18 when viewed from the second direction D2.

Similarly, although not shown, the first electrode layers 21 on the pair of side faces 2*e* and 2*f* are spaced apart from the coil conductors 16*a* through 16*f* when viewed from the third direction D3. That is, the first electrode layers 21 on the pair of side faces 2*e* and 2*f* do not overlap the coil conductors 16*a* to 16*f* when viewed from the third direction D3. The first electrode layers 21 on the pair of side faces 2*e* and 2*f* overlap the pair of connection conductors 17 and 18 when viewed from the third direction D3. In other words, the first electrode layers 21 included in the electrode portions 4*c* and the electrode portions 5*c* are spaced apart from the coil conductors 16*a* to 16*f* and overlap the pair of connection conductors 17 and 18 when viewed from the third direction D3.

As described above, in the laminated coil component 1, the second electrode layers 23 are disposed in such a way as to cover the entire end edges 21*a* of the first electrode layers 21 on the main face 2*c*. Thus, the second electrode layers 23 absorb impact on the end edges 21*a* of the first electrode layers 21 on the main face 2*c*. When the laminated coil component 1 is mounted on an electronic device, stress caused by deflection of the electronic device tends to be concentrated on the end edges 21*a* of the first electrode layers 21 at the end portions of the main face 2*c*, the mounting face, in the third direction D3. In the embodiment, the clearance between the end edges 23*a* of the second electrode layers 23 and the end edges 21*a* of the first electrode layers 21 on the main face 2*c* in the first direction. D1 is longer at the end portions than at the central portions of the main face 2*c* in the third direction D3 (L1>L2). That is, on the main face 2*c*, a length, in the first direction. D1, of extra portions provided in the second electrode layers 23 for the first electrode layers 21 is longer at the end portions than at the central portions in the third direction D3. This can further suppress the occurrence of cracks in the body 2.

In the laminated coil component 1, the first electrode length at the end portions of the main face 2*c* in the third direction D3 is shorter than the first electrode length at the central portions of the main face 2*c* in the third direction D3. Thus, the end edges 21*a* of the first electrode layers 21 at the end portions of the main face 2*c* in the third direction D3, where cracks start in the body 2, can be brought close to the corner portions of the end faces 2*a* and 2*b*. The stress caused by the deflection of the electronic device is hardly applied to the corner portions of the end faces 2*a* and 2*b*. As a result, the occurrence of cracks in the body 2 can be further suppressed.

The first electrode layers 21 are base metal layers for forming the second electrode layers 23, and the first electrode layers 21 with larger areas can suppress the separation of the second electrode layers 23 more. In the laminated coil component 1, the first electrode length is long at the central portions of the main face 2*c* in the third direction D3. Thus, the areas of the first electrode layers 21 are kept large at the central portions of the main face 2*c* in the third direction D3. This can easily achieve a structure in which the length, in the first direction D1, of the extra portions provided in the second electrode layers 23 for the first electrode layers 21 is longer at the end portions than at the central portions of the main face 2*c* in the third direction D3 while the separation of the second electrode layers 23 is suppressed.

The end edges 21*a* of the first electrode layers 21 on the main face 2*c* are curved in such a way as to protrude from the central portions in the third direction. D3 when viewed from the second direction D2. The end edges 21*a* of the first electrode layers 21 on the main face 2*c* are longer than the straight end edges 21*a* since the end edges 21*a* are curved. This can disperse the stress which causes cracks.

In the laminated coil component 1, the end edges 23*a* of the second electrode layers 23 on the main face 2*c* are curved. Thus, the end edges 23*a* of the second electrode layers 23 on the main face 2*c* are longer than the straight end edges 23*a*. Since this can disperse the stress concentrated on the end edges 23*a* of the second electrode layers 23 on the main face 2*a*, the occurrence of cracks in the body 2 starting from the end edges 23*a* of the second electrode layers 23 can be suppressed.

The laminated coil component 1 further includes the coil conductors 16*a* to 16*f* constituting the coil 15 inside the body 2. The first electrode layers 21 on the main face 2*c* are spaced apart from the coil conductors 16*a* to 16*f* when viewed from the second direction D2. Thus, even if cracks occur in the body 2 starting from the end edges 21*a* of the first electrode layers 21 at the end portions of the main face 2*c* in the third direction D3, the cracks hardly affect the coil conductors 16*a* to 16*f*. Therefore, deterioration of the electrical characteristics of the coil 15 is suppressed.

Although the embodiment has been described above, the present invention is not necessarily limited to the above embodiment, and various changes can be made within a scope not departing from the gist thereof.

For example, the shapes of the first electrode layers 21 and the second electrode layers 23 on the main face 2*c* are not limited to the above shapes as long as the relationship of L1>L2 is met.

Figure 5:
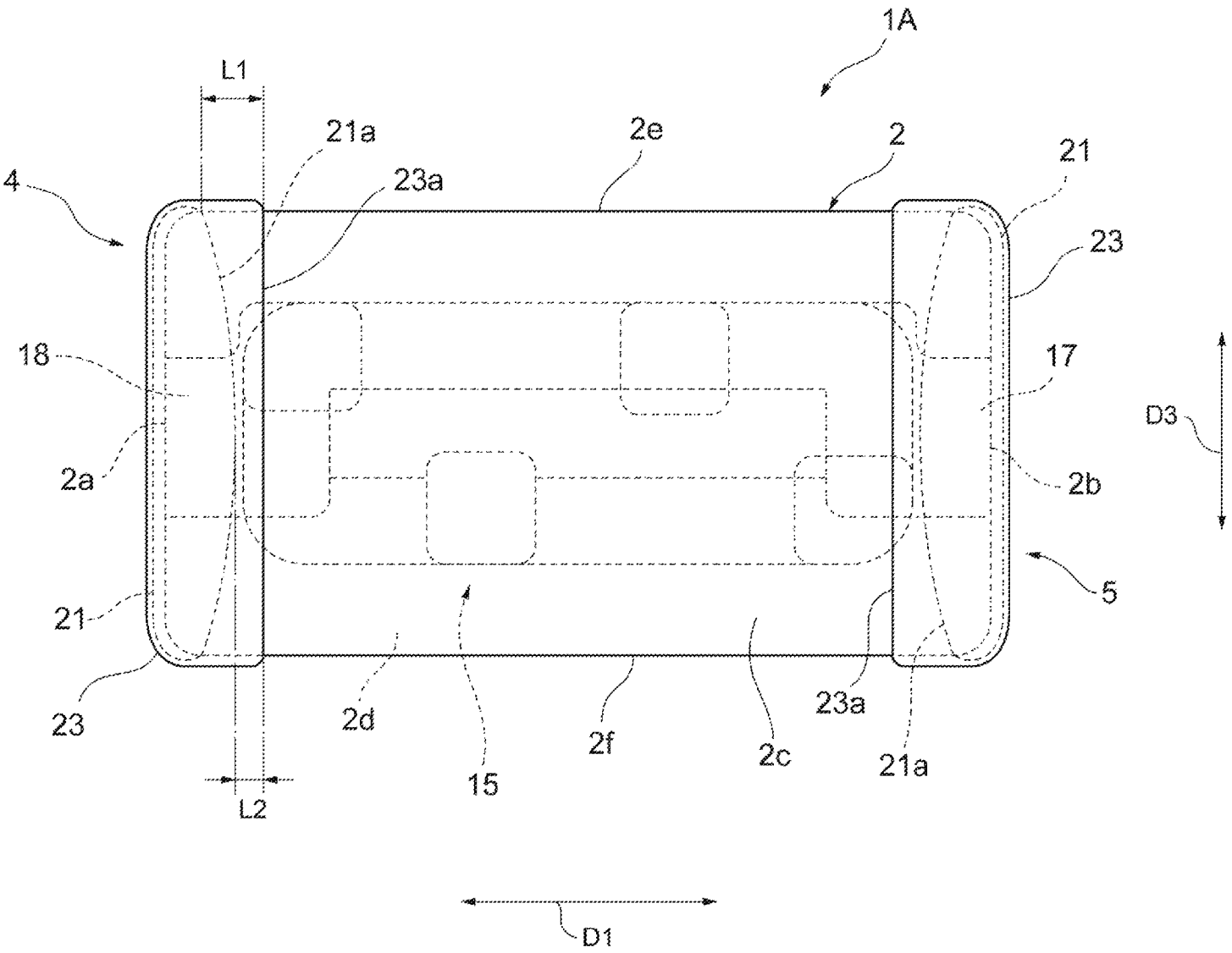
FIG. 5 is a plan view of a laminated coil component according to a first modification example.

FIG. 5 is a plan view of a laminated coil component according to a first modification example. As shown in FIG. 5, a laminated coil component 1A according to the first modification example differs from the laminated coil component 1 in terms of the shape of the second electrode layers 23 and coincides with the laminated coil component 1 in other features. In FIG. 5, the third electrode layers 25 and the fourth electrode layers 27 are omitted. In the laminated coil component 1A, the end edges 23*a* of the second electrode layers 23 on the main face 2*c* are not curved but straight when viewed from the second direction D2 (see FIG. 1). That is, the second electrode length is constant regardless of the positions on the main face 2*c* in the third direction D3.

Since L1>L2 is met also in the laminated coil component 1A as in the laminated coil component 1, the occurrence of cracks in the body 2 can be further suppressed. In the laminated coil component 1A, the end edges 23*a* of the second electrode layers 23 on the main face 2*c* are straight when viewed from the second direction D2, and the second electrode length is constant. Thus, L1 is more easily lengthened in the laminated coil component 1A than in the laminated coil component 1 in which the first electrode length at the end portions of the main face 2*c* in the third direction D3 is shorter than the first electrode length at the central portions of the main face 2*c* in the third direction D3. As a result, the end edges 21*a* of the first electrode layers 21 at the end portions of the main face 2*c* in the third direction D3 are more easily protected by the second electrode layers 23 and the occurrence of cracks in the body 2 is more easily suppressed further in the laminated coil component 1A than in the laminated coil component 1.

Figure 6:
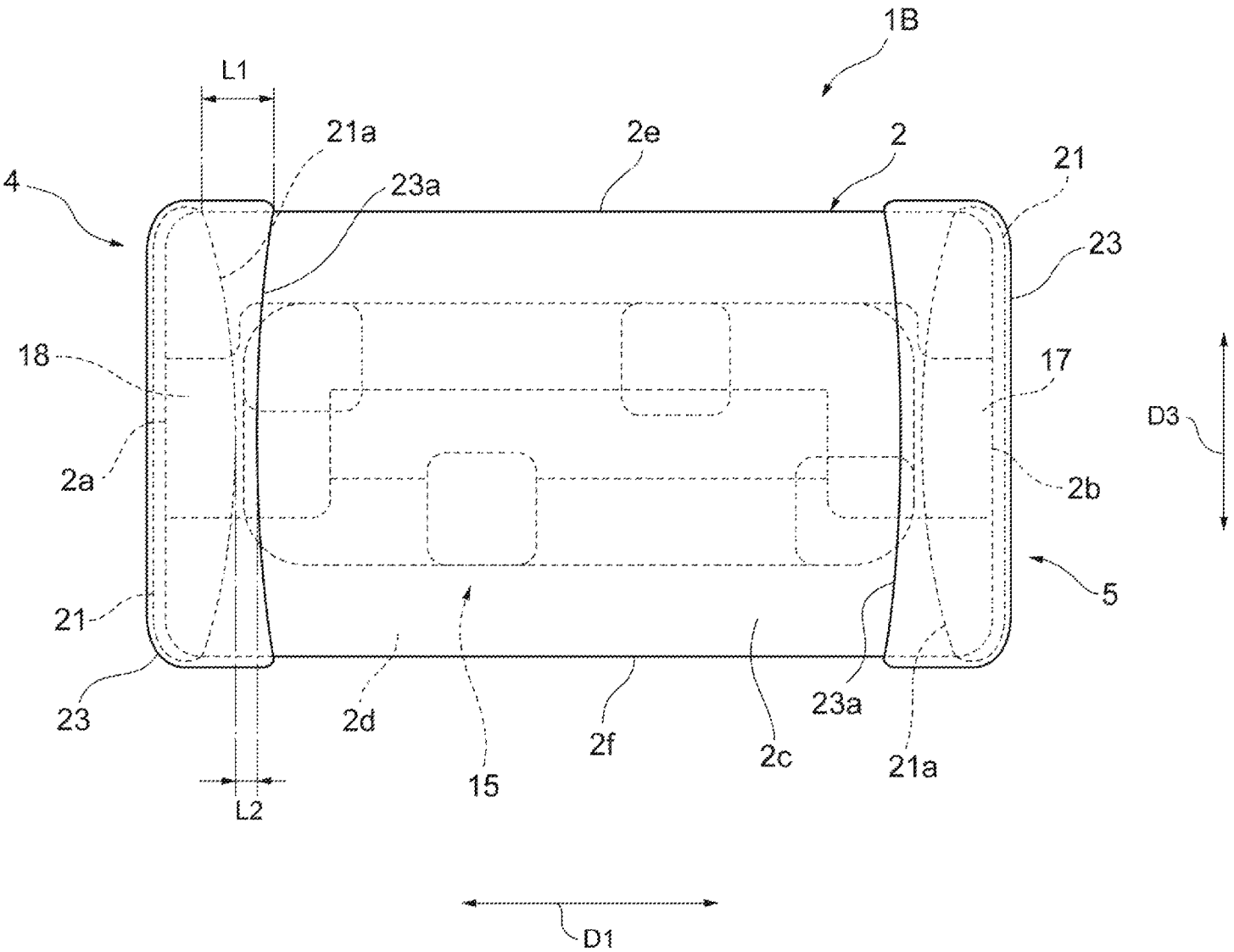
FIG. 6 is a plan view of a laminated coil component according to a second modification example.

FIG. 6 is a plan view of a laminated coil component according to a second modification example. As shown in FIG. 6, s laminated coil component 1B according to the second modification example differs from the laminated coil component 1 in terms of the shape of the second electrode layers 23 and coincides with the laminated coil component 1 in other features. In FIG. 6, the third electrode layers 25 and the fourth electrode layers 27 are omitted. In the laminated coil component 1B, the end edges 23*a* of the second electrode layers 23 on the main face 2*c* are curved in such a way as to be depressed at the central portions of the main face 2*c* in the third direction D3 when viewed from the second direction D2. The second electrode length at the end portions in the third direction D3 is longer than the second electrode length at the central portions in the third direction D3. The second electrode length becomes the longest at the end portions and the shortest at the central portions of the main face 2*c* in the third direction D3. The second electrode length monotonically decreases from the end portions to the central portions in the third direction D3. Herein, the monotonic decrease means that there is no tendency to increase and means a monotonic decrease in a broad sense.

Since L1>L2 is met also in the laminated coil component 1B as in the laminated coil component 1, the occurrence of cracks in the body 2 can be further suppressed. In the laminated coil component 1B, the end edges 23*a* of the second electrode layers 23 on the main face 2*c* are curved in such a way as to be depressed at the central portions of the main face 2*c* in the third direction D3 when viewed from the second direction D2, and the second electrode length at the end portions in the third direction D3 is longer than the second electrode length at the central portions in the third direction D3. Thus, L1 is more easily lengthened in the laminated coil component 1B than in the laminated coil component 1. L1 is also more easily lengthened in the laminated coil component 1B than the laminated coil component 1A. As a result, the end edges 21*a* of the first electrode layers 21 at the end portions of the main face 2*c* in the third direction D3 are more easily protected by the second electrode layers 23 and the occurrence of cracks in the body 2 is more easily suppressed further in the laminated coil component 1B than in the laminated coil component 1 and the laminated coil component 1A.

Figure 7:
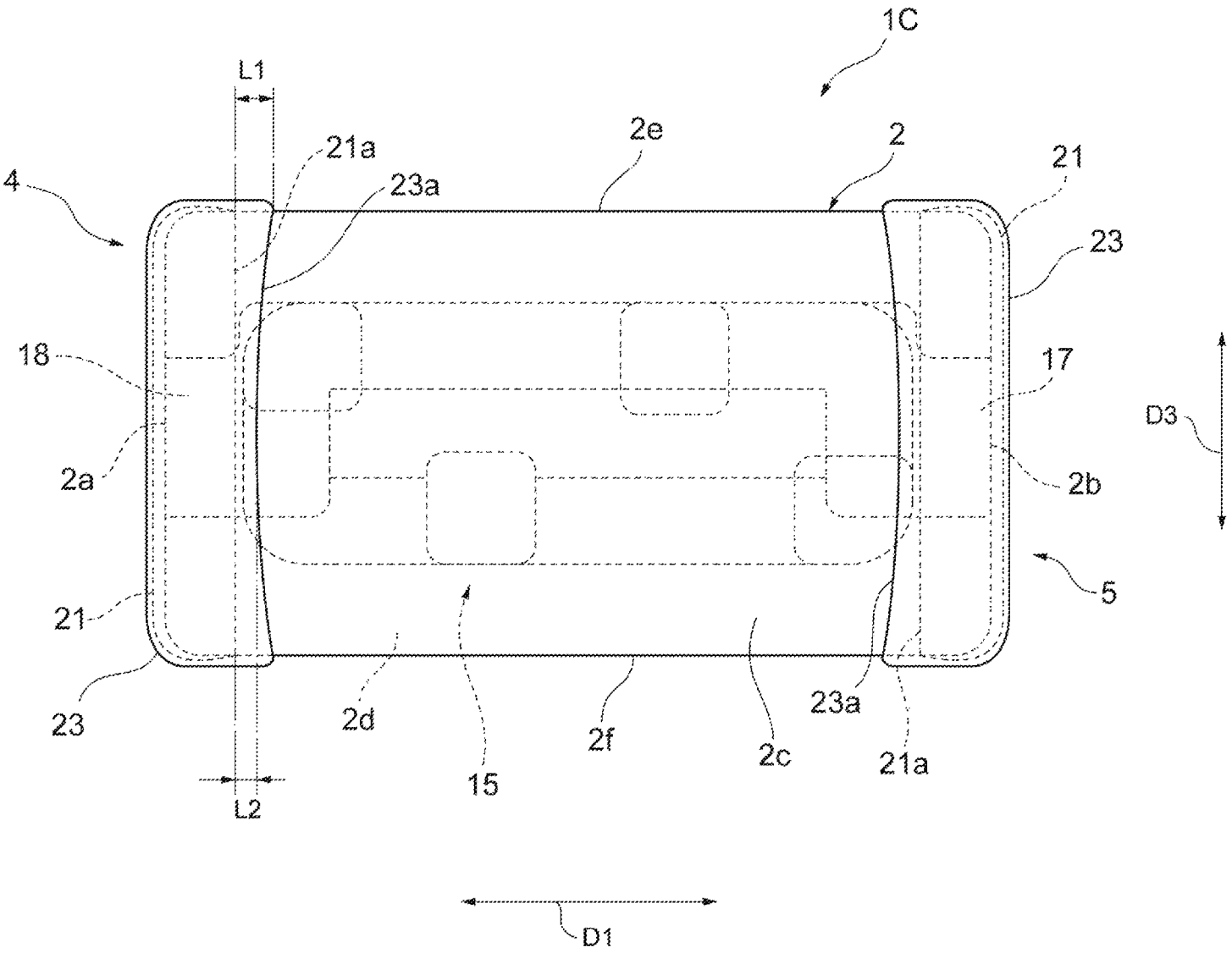
FIG. 7 is a plan view of a laminated coil component according to a third modification example.

FIG. 7 is a plan view of a laminated coil component according to a third modification example. As shown in FIG. 7, a laminated coil component 1C according to the third modification example differs from the laminated coil component 1 in terms of the shapes of the first electrode layers 21 and the second electrode layers 23 and coincides with the laminated coil component 1 in other features. In FIG. 7, the third electrode layers 25 and the fourth electrode layers 27 are omitted. In the laminated coil component 1C, the end edges 21*a* of the first electrode layers 21 on the main face 2*c* are not curved but straight when viewed from the second direction D2. That is, the first electrode length is constant regardless of the positions on the main face 2*c* in the third direction D3. Moreover, the end edges 23*a* of the second electrode layers 23 on the main face 2*c* are curved in such a way as to be depressed at the central portions of the main face 2*c* in the third direction D3 when viewed from the second direction D2. The second electrode length at the end portions in the third direction D3 is longer than the second electrode length at the central portions in the third direction D3. The second electrode length becomes the longest at the end portions and the shortest at the central portions of the main face 2*c* in the third direction D3. The second electrode length monotonically decreases from the end portions to the central portions in the third direction D3.

Since L1>L2 is met also in the laminated coil component 1C as in the laminated coil component 1, the occurrence of cracks in the body 2 can be further suppressed. In the laminated coil component 1C, the end edges 23*a* of the second electrode layers 23 on the main face 2*c* are curved in such a way as to be depressed at the central portions of the main face 2*c* in the third direction D3 when viewed from the second direction D2, and the second electrode length at the end portions in the third direction D3 is longer than the second electrode length at the central portions in the third direction D3. Thus, like the laminated coil component 1B, L1 is more easily lengthened in the laminated coil component 1C than in the laminated coil component 1 and the laminated coil component 1A. As a result, the end edges 21*a* of the first electrode layers 21 at the end portions of the main face 2*c* in the third direction D3 are more easily protected by the second electrode layers 23 and the occurrence of cracks in the body 2 is more easily suppressed further in the laminated coil component 1C than in the laminated coil component 1 and the laminated coil component 1A.

In the laminated coil components 1, 1A, 1B and 1C, the shapes of the first electrode layers 21 and the second electrode layers 23 on the main faces 2*c* and 2*d* and the side faces 2*e* and 2*f* are the same, but are not limited to these. These shapes may be different as long as the relationship of L1>L2 is met on at least on the main face 2*c*.

The pair of terminal electrodes 4 and 5 includes the third electrode layers 25 and the fourth electrode layers 27 as plated layers, that is, the plated layers include a plurality of plated layers, but are not limited to these. The plated layers may include one plated layer. Alternatively, the pair of terminal electrodes 4 and 5 does not have to include a plated layer.

The terminal electrode 4 is disposed on the five faces 2*a*, 2*a*, 2*d*, 2*e* and 2*f*, but is not limited to these. The terminal electrode 4 only have to be disposed at least on the end face 2*a* and the main face 2*a*, the mounting face. The terminal electrode 5 is disposed on the five faces 2*b*, 2*a*, 2*d*, 2*e* and 2*f*, but is not limited to these. The terminal electrode 5 only have to be disposed at least on the end face 2*b* and the main face 2*a*, the mounting face. The first electrode layers 21 are disposed on the pair of end faces 2*a* and 2*b*, the pair of main faces 2*c* and 2*d* and the pair of side faces 2*e* and 2*f*, but are not limited to these. The first electrode layers 21 only have to be disposed at least on the pair of end faces 2*a* and 2*b* and the main face 2*c*. The second electrode layers 23 are disposed in such a way as to cover the entire first electrode layers 21, but are not limited to these. The second electrode layers 23 only have to be disposed in such a way as to cover the entire end edges 21*a* of the first electrode layers 21 on the main face 2*c*.

In the embodiment, the laminated coil component 1 has been described as an example of the electronic component. However, the present invention is not limited this and may be applied to a laminated electronic component such as a laminated capacitor, a laminated varistor, a laminated piezoelectric actuator, a laminated thermistor or a laminated composite component, or an electronic component other than the laminated electronic component.

What is claimed is:

1. An electronic component, comprising:

a body with a rectangular parallelepiped shape, having a pair of end faces opposing each other in a first direction, a pair of main faces opposing each other in a second direction and a pair of side faces opposing each other in a third direction, in which one of the main faces serves as a mounting face; and a pair of terminal electrodes disposed on the pair of the end faces, wherein each of the pair of the terminal electrodes comprises a base metal layer disposed at least on each of the end faces and the one of the main faces, and a conductive resin layer disposed in such a way as to cover an entire end edge of the base metal layer on the one of the main faces, and a clearance in the first direction between an end edge of the conductive resin layer and the end edge of the base metal layer at an end portion of the one of the main faces in the third direction is longer than a clearance in the first direction between the end edge of the conductive resin layer and the end edge of the base metal layer at a central portion of the one of the main faces in the third direction, the clearance being a width in the first direction of an area of the one of the main faces covered by the conductive resin layer but not covered by the base metal layer.

2. The electronic component according to claim 1, wherein a length of the base metal layer in the first direction at the end portion of the one of the main faces in the third direction is shorter than a length of the base metal layer in the first direction at the central portion of the one of the main faces in the third direction.

3. The electronic component according to claim 1, wherein the end edge of the conductive resin layer on the one of the main faces is curved.

4. The electronic component according to claim 1, further comprising coil conductors constituting a coil inside the body, wherein the base metal layer on the one of the main faces is spaced apart from the coil conductors when viewed from the second direction.

* * * * *